United States Patent [19]

Bulmer et al.

[11] 4,090,171

[45] May 16, 1978

[54] UNDERWATER ACOUSTIC PRESSURE RELEASE REFLECTOR

[75] Inventors: Robert J. Bulmer, Gales Ferry; Edwin J. Parssinen, Mystic, both of Conn.

[73] Assignee: The United States of America as represented by the Secretary of the Navy, Washington, D.C.

[21] Appl. No.: 259,797

[22] Filed: Feb. 18, 1963

[51] Int. Cl.[2] ..... H01Q 15/14

[52] U.S. Cl. ..... 340/8 FT; 343/18 B

[58] Field of Search ..... 181/.5, .5 A; 340/8 RT, 340/8 FT, 8 PC; 343/18 B; 102/42, 95

[56] References Cited

U.S. PATENT DOCUMENTS 2,728,515 12/1955 Haire ..... 229/71

2,884,084 4/1959 Sussman ..... 340/8 FT

*Primary Examiner*—Malcolm F. Hubler

*Attorney, Agent, or Firm*—Richard S. Sciascia; Arthur A. McGill; Prithvi C. Lall

EXEMPLARY CLAIM

1. An underwater acoustic reflector for use at elevated hydrostatic pressure comprising:
   (A) a plurality of thin paper laminae assembled in an integrated stack wherein all the paper laminae run in essentially the same direction,
   (B) a thin-walled gas confining wrapping intimately surrounding and enclosing said stack of paper, and
   (C) a waterproof jacket enclosing said wrapped stack of paper and being of a material having characteristic acoustic impedance approximately the same as that of seawater enclosing said wrapped paper.

4 Claims, 4 Drawing Figures

UNDERWATER ACOUSTIC PRESSURE RELEASE REFLECTOR

The invention described herein may be manufactured and used by or for the Government of the United States of America for governmental purposes without the payment of any royalties thereon or therefor.

The invention relates to novel underwater acoustic reflectors and more particularly to acoustic reflectors for use under hydrostatic pressure higher than that at which previous acoustic reflectors could function successfully. More particularly, this invention relates to baffles that are useful in combination with transducers over a wide hydrostatic pressure range and under high hydrostatic pressure particularly, for increasing directivity index, for shielding any portion of a transducer from which no acoustic radiation is desired, to prevent acoustic short circuiting of the sound field for some types of transducers where the phase relationship between radiating parts of the transducer are disadvantageous, and to increase radiation loading.

A number of materials have been used heretofore for reflecting acoustic energy under water. Examples of such materials include celtite and corprene, and some specialized elastomerics marketed under tradenames familiar in the art. None of these well-known acoustic reflecting materials used heretofore at low hydrostatic pressure retain their desirable reflecting properties at elevated hydrostatic pressure. Furthermore, we have observed that desirable low pressure acoustic properties of the previously used reflecting materials are often severely impaired after the materials are subjected to high hydrostatic pressure.

An object of this invention is to provide a novel, superior underwater acoustic energy reflector for use over a wide range of hydrostatic pressure, from atmospheric pressure upward, and having substantially stable uniform reflectivity characteristics.

A further object is to provide an underwater acoustic pressure release reflector that can be fabricated of readily available material, is simple, inexpensive, light weight, has good water-tight integrity, has good reflectivity characteristics at low hydrostatic pressure and, in addition, has good reflectivity at hydrostatic pressure higher than that at which prior art pressure release reflectors can function satisfactorily.

A further object of the invention is to provide an underwater acoustic energy reflector that has high mechanical Q and retains the high mechanical Q at substantially elevated pressure.

A further object is to provide a method for improving the reflecting of waterborne acoustic energy, over a wider range of hydrostatic pressure, and over a wide frequency band.

Other objects and advantages will appear from the following description of an example of the invention, and the novel features will be particularly pointed out in the appended claims.

Figure 1:
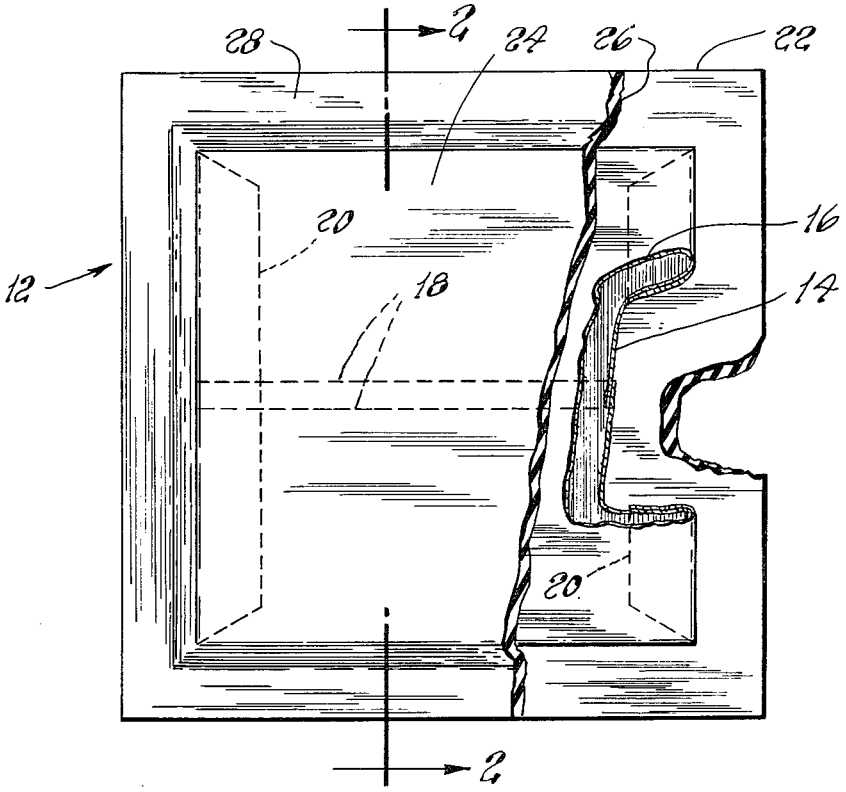
FIG. 1 is a plan view, partly broken away of an embodiment of the invention.

In its broader aspects, this invention relates to reflecting waterborne acoustic energy with sheet or more broadly laminar dry paper compactly stacked functioning as a pressure release material. Neither the thickness of the individual sheet of paper, nor the dimensions of the stack, nor the type of paper, nor the fiber orientation, is a critical factor in the invention. All of these factors can be varied considerably within the scope of this invention. The stacked paper is confined within a low mechanical loss, water impervious jacket. Frequency has to be considered in choosing the thickness dimension of the reflector because the stack is a poor reflector of incident acoustic energy at a frequency where a half wavelength measured in the reflector is substantially equal to the thickness dimension of the reflector.

One salient characteristic of the invention is that it performs exceptionally well as an acoustic reflector under elevated hydrostatic pressure. Secondly, its reflection characteristic is essentially stable over a broad pressure range. Thirdly, its reflection characteristic does not deviate appreciably over a broad pressure range. Fourth, it performs well at low hydrostatic pressure. Fifth, repeated subjections to high hydrostatic pressures does not significantly change its characteristics.

The compact paper stack may be comprised of equal size sheets assembled in aligned face to face relationship or unequal size sheets in overlapping relationship, or sheets of paper in various geometric shapes including narrow strip shape and of various sizes assembled in overlapping essentially parallel relationship. The individual paper elements of the stack must not be bonded together by any adhesive.

While this invention contemplates a wide variety of paper, onion skin paper of 100 percent cotton fiber provides better results in this invention. The paper is essentially dry. While paper having a degree of dryness corresponding to long term exposure to ambient conditions may be used in this invention, superior results obtain where the paper is freed of as much moisture as is possible. Preferably, the paper is dried in an oven over a period of several hours at a temperature on the order of 250° F.

The compliance and the good reflectivity characteristics of the paper stack, particularly under high hydrostatic pressure, apparently are related to the quantity of gas trapped between contiguous paper elements and in the irregular interstices in each paper element. A single, thin layer, low mechanical loss wrapping surrounding and enclosing the paper stack resists escape of the gas initially trapped in the paper for a longer period of time. Aluminum foil 0.001 inch or film-thin non-permeable plastic such as mylar is satisfactory for this purpose. Preferably the seam of the wrapping extends across the center of one face of the paper stack. Adhesive sealing of the wrapping seal is permissable but not essential since the degree of benefit realized is relatively unimportant and does entail more labor cost.

The water impervious jacket should have as low mechanical loss as is practical consistent with strength, durability, and other consideration. In some applications the jacket is depended upon to lend physical support to the paper stack and to facilitate mounting the stack on a frame or base. Neoprene rubber is one suitable material for the jacket, being non-permeable to water, is not mechanically lossy, and can easily be vulcanized. Butyl rubber (isobutylene-isoprene) is another material suitable for jacketing the paper having similar desirable properties.

Figure 2:
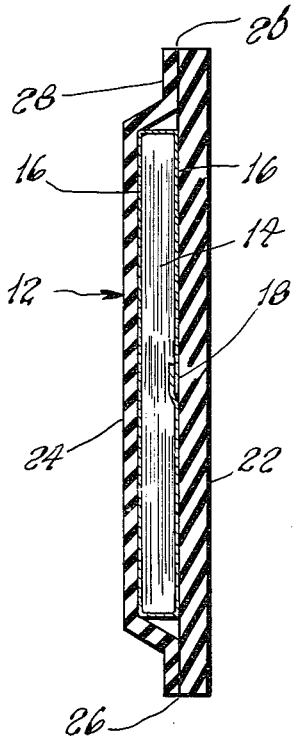
FIG. 2 is a sectional view taken on line 2—2 of FIG. 1.

An embodiment of this invention in the form of a square tile 12 is shown in FIGS. 1 and 2. One advantage of the tile configuration is that it can be utilized as a module and assembled in combination with a number of other such modules into a large reflector or baffle. The modules may be cemented on a supporting surface or may be secured or mounted in a supporting frame, side by side. The module support may be designed for a planar reflecting surface or a curved reflecting surface. Another advantage of the tile configuration is that fabrication is relatively simple.

The tile 12 includes a compact stack of sheets of onion skin paper 14 of 100 percent cotton fiber. The stack of paper selected for the tile is ovendried for about four hours, removed from the oven, and left to cool to a temperature at which it can be handled safely and conveniently. If the paper is left standing in the atmosphere for an undue length of time, the advantage of oven drying is lost. Subsequently, the paper stack is surrounded and enclosed by a single thickness of aluminum foil 16, e.g. 0.001 inch thick that is non-permeable to gas.

The foil is folded around the paper stack so that a pair of opposite edges of the foil overlap and form a seam 18 along the center of one face of the paper stack and the other ends 20 are folded onto that same face. The foil wrapping and the central location of the seam optimize the chances of retaining a maximum percentage of the gas initially trapped in the paper between its layers and in the irregular interstices of each layer. While the seam and ends of the foil wrapping may be sealed with adhesive, the advantage realized from doing so is comparatively slight and must be weighed against the added labor cost. Generally, it is unnecessary to seal the wrapping. The wrapped paper stack is snugly confined between a bottom sheet of neoprene rubber about ⅛ inch thick and an upper sheet 24 of neoprene rubber about 1/16 inch thick for the reflecting face of the tile. The sheets of rubber are approximately 1½ inches wider and longer than the stack of paper so that the edges can be readily pressed together as part of a vulcanizing process to form a hermetic seal 26. The vulcanizing procedure may be carried out with the bottom sheet 22 of neoprene bearing against a flat surface. A square frame, not shown, is brought to bear against one-half inch to three-fourth inch wide peripheral border 28 of the upper sheet of rubber 24 around the stack of paper 14 and urged by a press, not shown, to force together the border 28 of the upper sheet of neoprene and a corresponding border of the lower sheet of neoprene to form with other conventional steps of a vulcanizing process an hermetic seal 26.

The reason for the foil wrapping 16 is that neoprene is somewhat permeable to gas measured over a long time period, and if the paper stack is not wrapped in foil, the useful life of the reflector is far shorter due to this loss of gas through the wall of the waterproof jacket, than it is with paper stack 14 confined in wrapping 16. To further minimize loss of gas, the seam face of the wrapping is disposed preferably against the thicker or bottom sheet of the jacket material since the rate of loss of gas through the thicker sheet is slower than it would be through the thinner sheet. Sealing the seam 18 and the folds 20 of the wrapping with adhesive contributes little because the seam and folds are effectively pressure sealed when in use under even low hydrostatic pressure.

In selecting the thickness of the paper stack and thus the number of sheets, the frequency character of the acoustic energy to be reflected is considered. The thickness should be substantially different than the size of a half wavelength of the frequency of interest measured in the paper stack material. The dimensions of the square are chosen for fabrication convenience, with due consideration to the size of the press available for use in vulcanizing the waterproof jacket, to storage convenience, and to assembly convenience of a large reflector from the modules 12.

The thickness of the bottom and upper sheets of the jacket are a compromise between low mechanical loss on the one hand, and strength, durability, and fabrication problems on the other hand.

Tiles as in FIGS. 1 and 2, including 250 sheets of onion skin paper 6½ inches square and of approximately 11/16 total thickness were successfully used for reflecting waterborne acoustic energy up to 16KC with less than 3 db loss in reflection coefficient following repeated cycling between 0 and 1000 pounds per square inch hydrostatic pressure. The frequencies at which the reflection coefficient loss is excessive is shifted if the thickness of the stack of paper is changed.

Figure 3:
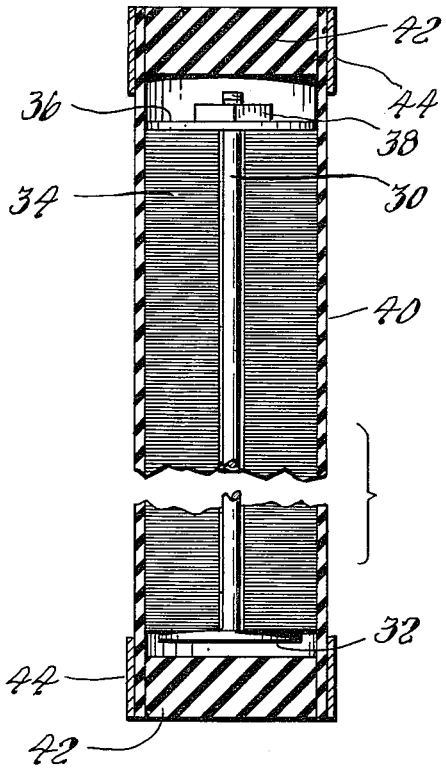
FIGS. 3 and 4 are sectional views of embodiments of the invention.
Figure 4:
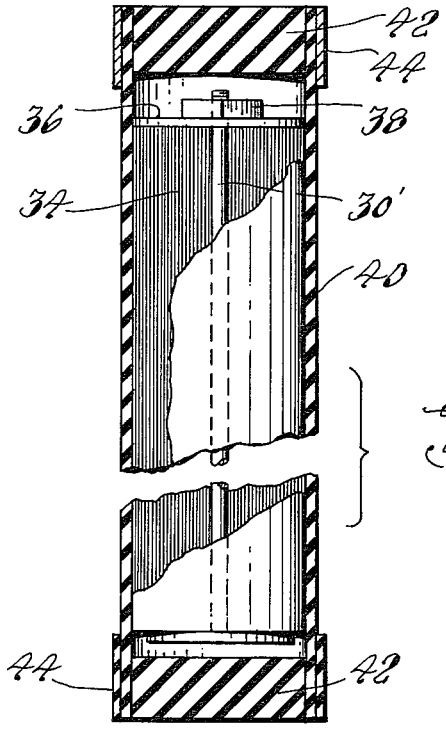

In FIGS. 3 and 4 there are shown two materially different embodiments for carrying out the method of reflecting waterborne acoustic energy with paper laminae. The embodiment shown in FIG. 3 includes a rigid rod 30, e.g. ⅛ inch diameter, terminated at one end by a nut or flange 32 and threaded at the opposite end. A stack of substantially identical paper disks 34 each of which has a central perforation of slightly larger diameter than the diameter of the rod 30 is assembled on the rod. The stack of paper disks 34 is compressed between the flange 32 on one end, and a flat washer 36 and a nut 38 threaded on the other end of the rod. Excess length of the rod 30 extending beyond the nut 38 is cut off after assembly. The assembled stack of paper disks is disposed in a closely fitted tubular neoprene rubber jacket 40 sealed at both ends with neoprene rubber plugs 42 and tensioned metal bands 44. This embodiment is more difficult to fabricate than the embodiment shown in FIGS. 1 and 2 because the paper disks tend to be caught in the threads of the dowel during assembly and because some of the paper disks may tear or crumple in the process. The embodiment shown in FIG. 4 differs from the one shown in FIG. 3 in that sheet paper 50 is coiled tightly onto the rod 30' under as much tension as is practical after its leading edge or lip is cemented to the rod. Then the coiled paper is clamped tightly between a nut and flange at opposite ends of the rod. Tight winding minimizes the possibility of deformation and of subsequent leakage. The excess length of rod is cut off and the assembly is jacketed in neoprene rubber as shown and described for the embodiment shown in FIG. 3. The outside diameter of the paper on the rod corresponds to the thickness dimension of the paper stack in FIGS. 1 and 2 and should be substantially different from a ½ wavelength of the frequency of interest measured in the paper.

A plurality of units as shown in FIGS. 3 or 4 are assembled on a support frame, not shown, in parallel, side-by-side, or spaced apart on centers a distance no greater than ½ wavelength of the frequency of interest measured in water, to form a planar or curved reflector or baffle.

It will be understood that various changes in the details, materials and arrangements of parts (and steps), which have been herein described and illustrated in order to explain the nature of the invention, may be made by those skilled in the art within the principle and scope of the invention as expressed in the appended claims.

We claim:

1. An underwater acoustic reflector for use at elevated hydrostatic comprising:

(A) a plurality of thin paper laminae assembled in an integrated stack wherein all the paper laminae run in essentially the same direction, (B) a thin-walled gas confining wrapping intimately surrounding and enclosing said stack of paper, and (C) a waterproof jacket enclosing said wrapped stack of paper and being of a material having characteristic acoustic impedance approximately the same as that of seawater enclosing said wrapped paper.

2. An underwater acoustic reflector tile comprising:

(A) a compact rectangular-shaped stack of paper, and (B) a waterproof jacket for the stack of paper including (a) a rectangular flat base supporting one face of the stack and extending slightly beyond the four edges of the stack, (b) a sheet of neoprene rubber extending across the other face of the stack and bonded to the portions of the flat base extending beyond the four edges of the stack all around the perimeter.

3. An underwater acoustic reflector for use at elevated hydrostatic pressure comprising:

(A) a stack of sheets of oven-dried paper, (B) a thin foil-like gas-confining wrapping up to 0.001 inch thick surrounding and enclosing said stack of sheets, said wrapping being of a low mechanical loss and non-permeable material, and (C) a waterproof jacket of a material having characteristic acoustic impedance approximately the same as that of water enclosing said paper and wrapping.

4. An underwater acoustic reflector having approximately uniform reflectivity over a wide range of hydrostatic pressure including -1000 pounds per square inch comprising:

(A) a compact stack of oven-dried onion skin paper of 100 percent cotton fiber having total thickness equal to a major fraction of one inch, (B) a thin single-layer foil-like gas-confining wrapping of low mechanical loss non-permeable material surrounding and enclosing said paper and having a seam extending centrally across one face of the stack of paper, (C) a rectangular flat base of neoprene rubber about one-eighth inch thick supporting one face of the foil-wrapped paper stack and extending laterally beyond the edges of the stack all around the perimeter, and (D) a sheet of neoprene rubber extending across the other face of the foil-wrapped paper stack and bonded to the portions of the flat base extending beyond the edges of the stack all around the perimeter forming a hermetic seal therewith.

* * * * *